US005433376A

United States Patent [19]

Kueshner

[11] Patent Number: 5,433,376

[45] Date of Patent: Jul. 18, 1995

[54] RETRACTABLE MAIL BOX

[76] Inventor: Kenneth Kueshner, 96 Carson Hghts. Dr., Duncansville, Pa. 16635

[21] Appl. No.: 239,234

[22] Filed: May 6, 1994

[51] Int. Cl.[6] ..... B65D 91/00; A47G 29/12

[52] U.S. Cl. ..... 232/39; 232/17; 248/293

[58] Field of Search ..... 232/39, 17, 35; 248/145, 293, 299, 585

[56] References Cited

U.S. PATENT DOCUMENTS

| | | | |
|---|---|---|---|
| 826,686 | 7/1906 | Oliver | 232/39 |
| 1,122,746 | 12/1914 | Halling | 232/39 |
| 1,430,476 | 9/1922 | Trekell | 232/39 |
| 1,602,711 | 10/1926 | Schneider | 232/39 |
| 2,438,043 | 3/1948 | Ernst | 248/145 |
| 2,898,066 | 8/1959 | Ouellette | 248/145 |
| 3,637,178 | 1/1972 | Golden | 248/145 |
| 4,130,239 | 12/1978 | Belsheim | 232/39 |
| 4,172,579 | 10/1979 | Steinman | 232/39 |
| 5,224,677 | 7/1993 | Close | 248/585 |

*Primary Examiner*—Michael J. Milano
*Attorney, Agent, or Firm*—Armstrong, Westernman, Hattori, McLeland & Naughton

[57] ABSTRACT

A retractable and extendable mail box comprising a vertical support disposed adjacent and spaced from the side of a road, a horizontal support member mounted on the vertical support and extending toward the road, a platform hingedly connected to the horizontal support member, a mail box mounted on the platform, a spring and shock absorber to extend and retract the platform and associated mail box, and a semi-rigid pull member attached to the mail box and having a free end extending in a arc such that, in a retracted position of the mail box, the free end of the pull member is disposed at a position in the road or on the road's edge to which a snowbank or other physical barrier extends and blocks access to the retracted mail box, whereby, when the pull member is pulled downwardly, the platform and associated mail box are extended to an access position across the snowbank or other barrier.

7 Claims, 2 Drawing Sheets

RETRACTABLE MAIL BOX

FIELD OF THE INVENTION

This invention relates to a mail box which can be extended from a retracted position so as to provide easy access to the box from a road along which the box is mounted when heavy snow or other barrier blocks access to the box in the retracted position.

BACKGROUND OF THE INVENTION

Normally mail boxes, especially in rural areas, are mounted on a vertical post located at or near the edge of a road, so as to provide easy access to a mail carrier. Such positioning of a mail box works satisfactorily most of the time, but when heavy snow falls and the road is plowed, snowbanks block access to the box. In heavy snowfall areas, such snowbanks can be as much as three feet wide or greater. To provide access, the snow bank must be shovelled out at great effort and sometimes at frequent intervals. If this is not doen, and access to the box is prevented, the mail carrier can refuse to deliver mail.

SUMMARY OF THE INVENTION

This invention provides a mail box mounted on an extendable platform hinged to a horizontal support member which is mounted on a vertical support member positioned at a predetermined position spaced from the edge of a road. A spring member is fixed at one end to the mail box and at the other end to the horizontal support member. A pneumatic piston/cylinder assembly, or shock absorber, is fixed at one end to the extendable platform and at the other end to the horizontal support member. The length dimensions of the platform and the horizontal support member are selected so that, on extension of the platform, the mail box is positioned past the edge of the road toward the center of the road, for example, a distance of about three feet. Attached to the mail box is a semi-rigid pull member which, in the retracted position of the box, lies in an arc having its greatest distance from the box at least equal to the position of the box in its extended position, i.e. a substantial distance from the edge of the road and at least equal to the likely width of a snowbank resulting from a heavy snowfall and plowing of the road.

PREFERRED EMBODIMENTS OF THE INVENTION

Figure 1:
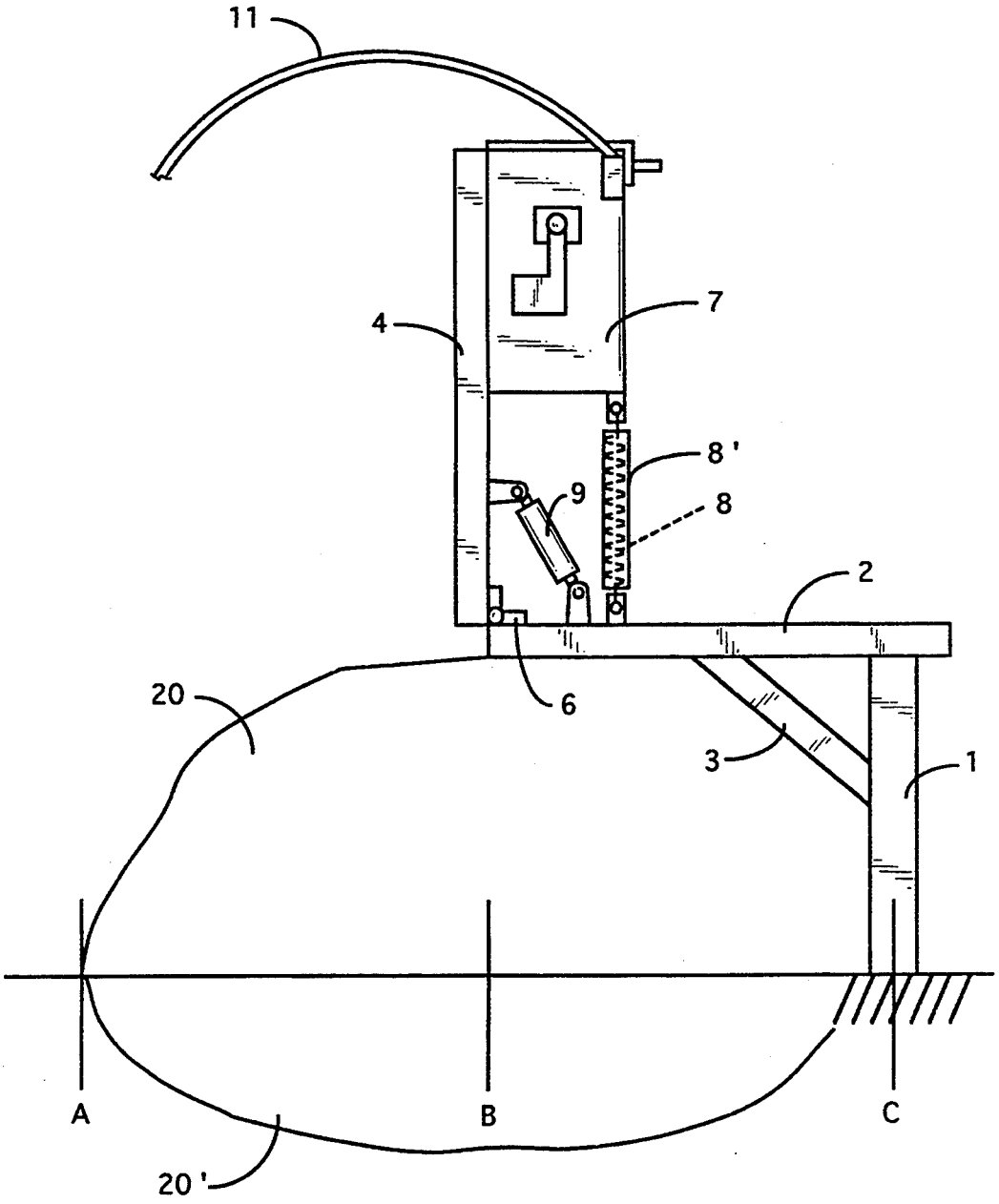
FIG. 1 is a side elevational view showing the mail box of the invention in its retracted position.

Referring to FIG. 1, the numeral 1 denots a vertical support post located at a position "C" spaced from a point "B" which is spaced from the edge of a road and which marks the position of a mailbox in a retracted position. Mounted on post 1 is a horizontal support member 2. A reinforcing member 3 may be provided to increase the strength of the mounting of member 2 on post 1. An extendable platform 4 is connected to one end of horizontal support member 2 by means of a hinge 6.

A mail box 7 is mounted on the outer portion of the platform 4. A spring member 8, with protective rubber boot 8', has one end thereof connected to a top rear surface of the box 7, and the other end of spring member 8 is connected to the horizontal support member 2 at a position spaced inwardly from the front end of member 2 (left end as viewed in FIGS. 1 and 2). A pneumatic piston/cylinder assembly, such as a pneumatic shock absorber, 9, is connected at one end to the platform 4 at a position spaced from the rear end thereof (right end as viewed in FIGS. 1 and 2), and the other end of the shock absorber 9 is connected to the horizontal support member 2 outwardly of the connection thereto of spring member 8 (to the left thereof as viewed in FIGS. 1 and 2). The shock absorber serves to dampen the spring-biased forces of extending and retracting the mail box.

Figure 2:
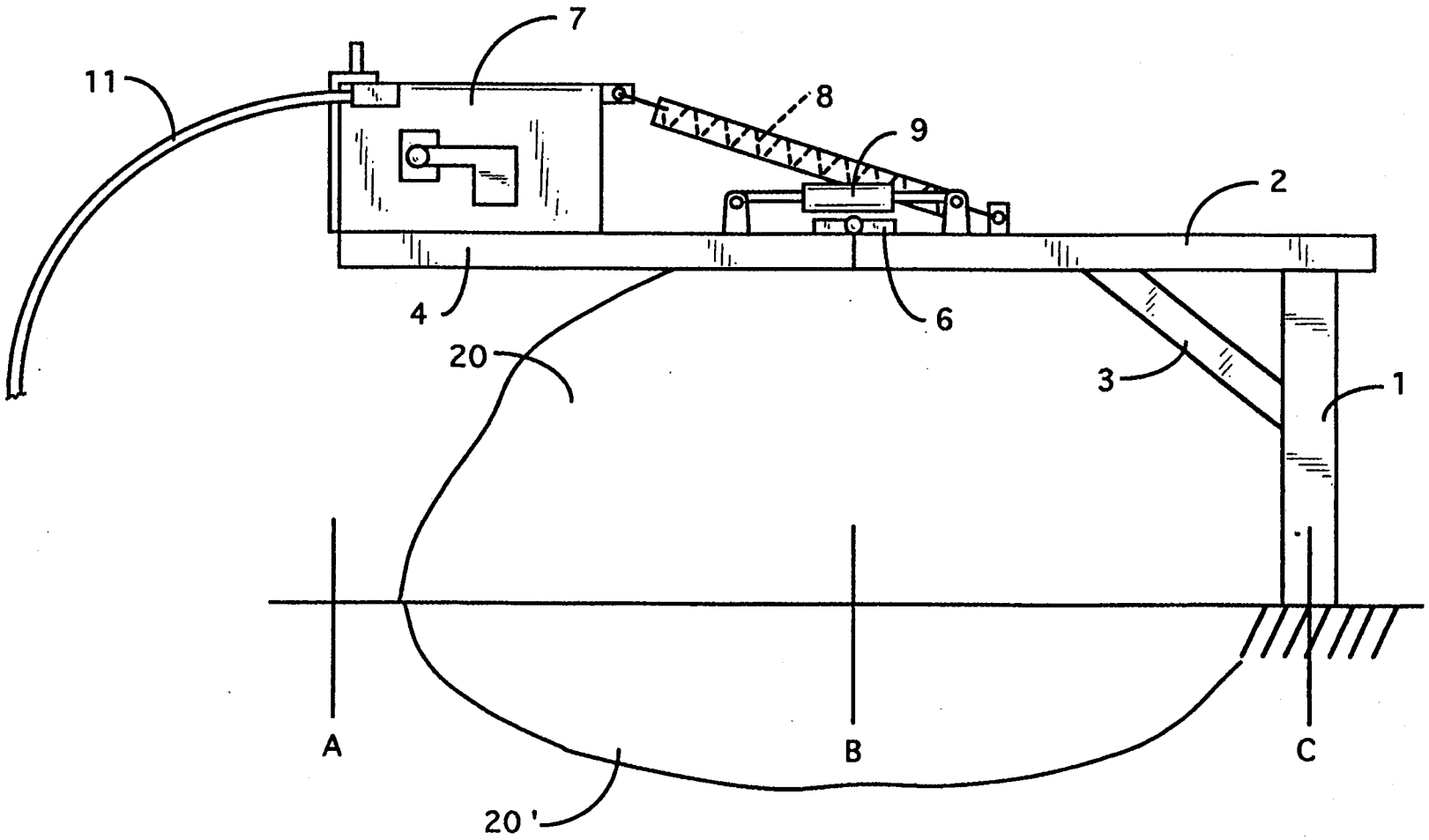
FIG. 2 is a side elevational view showing the mail box of the invention in its extended position.

After a heavy snowfall and plowing of the road, a snowbank may extend about three feet from position B and in front of the mail box, e.g. to about position A (FIGS. 1 and 2). Accordingly, platform 4 preferably has a length of about three feet, as does the horizontal support member 2.

A semi-rigid pull member 11 is connected to a front portion of the mail box 7 and, by virtue of its semi-rigid characteristic, when the box is in its retracted position, lies in an arc extending outwardly of the box and to approximately a position "A" corresponding to the outer surface of a snowbank 20 or other physical barrier, such as a ditch or trench 20', in front of the mail box, e.g. about three feet. Suitable materials for the pull member 11 include, for example, PVC or polybutylene tubing, e.g. of about $\frac{3}{8}$ inch o.d. and about 3/16 inch i.d.

Access to the mail box also may be blocked by mud or a trench lying in the area in front of position "B".

In operation, when a mail carrier wishes to place mail in the box or a recipient wishes to retrieve mail from the box under conditions where a snowbank 20 or other physical barrier blocks access to the box in its retracted position, the person pulls down on pull member 11, extending spring member 8 and shock absorber 9, to lower platform 4 and the attached mail box 7 to the fully extended position as illustrated in FIG. 2.

In seasons free of snow, spring member 8, with boot 8', and shock absorber 9 may be disconnected, and platform 4 may be mounted on horizontal support member 2, thus positioning the front of the mail box adjacent the side of the road, as at position "B". For such purpose, the support connections of the spring member 8 with boot 8' and shock absorber 9 may be provided with quick disconnect pins.

Normally, post 1, horizontal support member 2 and platform 4 are constructed of wood, but metal or other material may be used for any one or all of these members.

A second box (not shown) for reception of newspapers, may be affixed to the mail box 7.

What is claimed is:

1. A retractable and extendable mail box, comprising a vertical support member disposed adjacent and spaced from an edge of a road, a horizontal support member mounted on the vertical support member and projecting forwardly thereof in a direction of the road, a platform having one end thereof hingedly connected to the end of the horizontal support member extending in the direction of the road, a mail box mounted on and adjacent the other end of the platform, means to retract and extend the platform and associated mail box, and a semi-rigid pull member connected at one end to the mail box and having the other end free and, in a retracted position of the mail box, lying in an arc with the free end positioned approximately at the position of an outer surface of a snowbank lying in the road and blocking access to the mail box in its retracted position, and whereby, when the pull member is pulled downwardly, the platform and the mail box mounted thereon are lowered to an extended position providing access to the mail box across the snowbank.

2. A retractable and extendable mail box, comprising a vertical support member, a horizontal support member mounted on the vertical support member, a platform having one end thereof hingedly connected to one end of the horizontal support member, a mail box mounted on and adjacent the other end of the platform, a spring member connected at one end to the mail box and at the other end to the horizontal support member, a pneumatic shock absorber connected at one end to the platform and at the other end to the horizontal support member, and a semi-rigid pull member connected at one end to the mail box and having the other end free, whereby, in a retracted position of the mail box, the pull member lies in an arc with the free end positioned approximately at the position of an outer surface of a snowbank blocking access to the mail box in its retracted position, and whereby, when the pull member is pulled downwardly, the platform and the mail box mounted thereon are lowered to an extended position providing access to the mail box across the snowbank.

3. A retractable and extendable mail box, comprising:

a vertical support member disposed adjacent and spaced from an edge of a road;

a horizontal support member mounted on the vertical support member and projecting forwardly thereof in a direction of the road;

a platform having one end thereof hingedly connected to the horizontal support member extending in the direction of the road;

at least one mail box mounted on and adjacent the other end of the platform;

means to bias said platform and associated at least one mail box in a vertical position relative to said horizontal support member;

and a semi-rigid pull member connected at one end to at least one mail box or the platform and having the other end free and, in a retracted position of the mail box, lying in an arc with the free end positioned approximately at the position of an outer surface of a physical barrier between said horizontal support member and said road and blocking access to the mail box in its retracted position, and whereby, when the pull member is pulled downwardly, the platform and said at least one mail box mounted thereon are lowered to an extended position providing access to said at least one mail box across the physical barrier.

4. A retractable and extendable mail box, comprising:

a vertical support member;

a horizontal support member mounted on the vertical support member;

a platform having one end thereof hingedly connected to the horizontal support member;

a mail box mounted on and adjacent the other end of the platform;

means for biasing said platform in a vertical position relative to said horizontal support member;

means for dampening the force of said biasing means upon return of said platform from an extended to a retracted position;

and a semi-rigid pull member connected at one end thereof to the mail box or the platform and having the other end thereof free, whereby, in a retracted position of the mail box, the pull member lies in an arc with the free end positioned approximately at a position of an outer surface of a physical barrier between said horizontal support member and said road and blocking access to the mail box in its retracted position, and whereby, when the pull member is pulled downwardly, the platform and the mail box mounted thereon are lowered to an extended position providing access to the mail box across the physical barrier.

5. A retractable and extendable mail box in accordance with claim 4, wherein the means for biasing is a helical spring with a protective boot.

6. A retractable and extendable mail box in accordance with claim 4, wherein the means for dampening is a pneumatic shock absorber.

7. A method of providing access to a mail box across a physical barrier in front of the mail box and extending into a road beside which the mail box is mounted, comprising mounting a horizontal support member on a vertical member with one end of the horizontal support member extending away from the vertical support member in a direction of the road, hingedly connecting to said one end of the horizontal support member one end of an elongated platform, mounting a mail box upon a portion of the platform extending toward the road, exerting on the platform a biasing force to keep the platform in a normally upright, retracted position adjacent the edge of the road, attaching to the mail box a semi-rigid pull member having a free end extending in an arc to a road position to which the physical barrier extends, and pulling downwardly on the pull member to lower the platform and associated mail box to a position providing access to the mail box across the physical barrier.

* * * * *